US005174666A

United States Patent [19]

Martinez et al.

[11] Patent Number: 5,174,666

[45] Date of Patent: Dec. 29, 1992

[54] PRINTING DEVICE HAVING PRINTWHEEL COUPLING MEANS

[75] Inventors: Phillip M. Martinez, Dryden; Hans W. Mueller, Cortland, both of N.Y.

[73] Assignee: Smith Corona Corporation

[21] Appl. No.: 834,098

[22] Filed: Feb. 12, 1992

[51] Int. Cl.[5] ..... B41J 1/24

[52] U.S. Cl. ..... 400/174; 400/175; 400/144.2

[58] Field of Search ..... 400/174, 175, 144.2, 400/168

[56] References Cited

U.S. PATENT DOCUMENTS

| | | | |
|---|---|---|---|
| 4,124,930 | 11/1978 | Bauer | 400/174 |
| 4,161,373 | 7/1979 | Chvatlinsky | 400/175 |
| 4,512,676 | 4/1985 | Johansson | 400/175 |
| 4,542,999 | 9/1985 | Bauer et al. | 400/175 |
| 4,556,335 | 12/1985 | Morris | 400/144.2 |
| 4,600,324 | 7/1986 | Matsumori | 400/175 |
| 4,673,305 | 6/1987 | Crystal | 400/174 |
| 4,820,066 | 4/1989 | Link | 400/175 |

*Primary Examiner*—Edgar S. Burr
*Assistant Examiner*—Lynn D. Hendrickson

[57] ABSTRACT

A printing device having a detachable printwheel coupling means which includes a motor driven drive plate which is formed with a cantilevered spring finger and an aligning slot disposed on the side opposite the spring finger. The spring finger carries at its free end an alignment pin which automatically engages a radially offset cam surface located in a recess formed in the hub of a printwheel when the drive plate rotates relative to the printwheel. The printwheel hub also includes a drive pin which engages the aligning slot when the printwheel and drive plate abut under the urging of a pressure plate. The device inhibits angular and radial movement between the drive plate and the printwheel.

6 Claims, 3 Drawing Sheets

PRINTING DEVICE HAVING PRINTWHEEL COUPLING MEANS

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

BACKGROUND OF THE INVENTION

1. Field of the Invention

The present invention relates generally to printing devices such as typewriters and printers and more particularly to means for detachably coupling a typewriter or printer printwheel with a typewriter or printer drive plate. According to the present invention, the radial and angular position of the printwheel with respect to the drive plate is maintained in alignment and relative movement between the printwheel and the drive plate is inhibited.

2. Description of the Prior Art

Printwheels used in typewriters and printers ("printing devices") are generally affixed in such a manner as to be readily and easily removed and replaced in order to change the printwheel or, in some products in which the printwheel must be removed before changing the ribbon cartridge, to remove and replace the ribbon cartridge. It is desirable that the structure for affixing the printwheel should be simple, reliable and capable of being manufactured at low cost.

Attempts to achieve these characteristics have included, for example, the printing device disclosed in U.S. Pat. No. 4,556,335 which includes a printwheel centered on a printwheel drive shaft by an operator and prevented from slipping relative to the shaft by the spring-loaded retention of pivot posts in the channels of a printwheel connector. The printer disclosed in U.S. Pat. No. 4,542,999 includes a resilient "Z" shaped arm on a printwheel seated in a bracket by an operator which provides securement between the printwheel and the bracket by means of a wedgelike engagement in a recess formed in a bracket.

According to the present invention a hubbed printwheel has a recess formed with a radially offset cam surface. The drive plate associated with the printing device includes an alignment pin which engages the offset cam surface on the printwheel for inhibiting radial and angular movement of the printwheel relative to the drive plate. Smith Corona Corporation, the assignee of the present application, has sold prior art printing devices, such as its typewriter model XL 1700, which have included a hubbed printwheel having a recess formed with an offset cam surface.

The drive plates associated with the Smith Corona devices do not, however, include an alignment pin engaging the radial offset cam surface on a printwheel, nor do the drive plates include any structure for automatically engaging an alignment pin with a radial offset cam surface.

SUMMARY OF THE INVENTION

The purpose of the present invention is to provide a reliable detachable coupling means between a printwheel and a drive plate of a printing device . The present invention comprises a motor driven drive plate having an integral cantilevered spring finger which carries an alignment pin. The side of the drive plate opposite the alignment pin includes a central locating pin and an aligning slot. The printwheel includes a central hub which is formed with a recess. A driving pin is disposed on the printwheel central hub opposite the recess. The printwheel recess includes a radially offset sloping cam surface for receiving the alignment pin when the drive plate engages a printwheel hub and a drive plate aligning slot receives a drive pin on the printwheel hub. The spring finger urges the alignment pin into the printwheel recess and rotation of the drive plate forces the alignment pin against the sloped cam surface of the printwheel recess so as to prevent radial displacement of the printwheel with respect to the drive plate, and also to force the drive pin on the printwheel hub against a wall of the plate aligning slot to prevent relative angular movement between the printwheel and the drive plate.

Accordingly it is an object of this invention to provide a detachable coupling means between a printwheel and a drive plate for use in conjunction with a printing mechanism.

Another object of this invention is to provide a simple, easy to use detachable coupling between a printwheel and a drive plate of a printing device to prevent both radial and angular relative displacement between the printwheel and the drive plate.

Another object of this invention is to provide a detachable coupling between a printwheel and a drive plate which includes structure for automatically engaging an alignment pin on the drive plate with a radial offset cam surface on the printwheel for inhibiting radial and angular movement therebetween.

Still another object of this invention is to provide a detachable coupling between a printwheel and a drive plate whose components do not require close dimensional tolerances and can be manufactured at low cost.

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
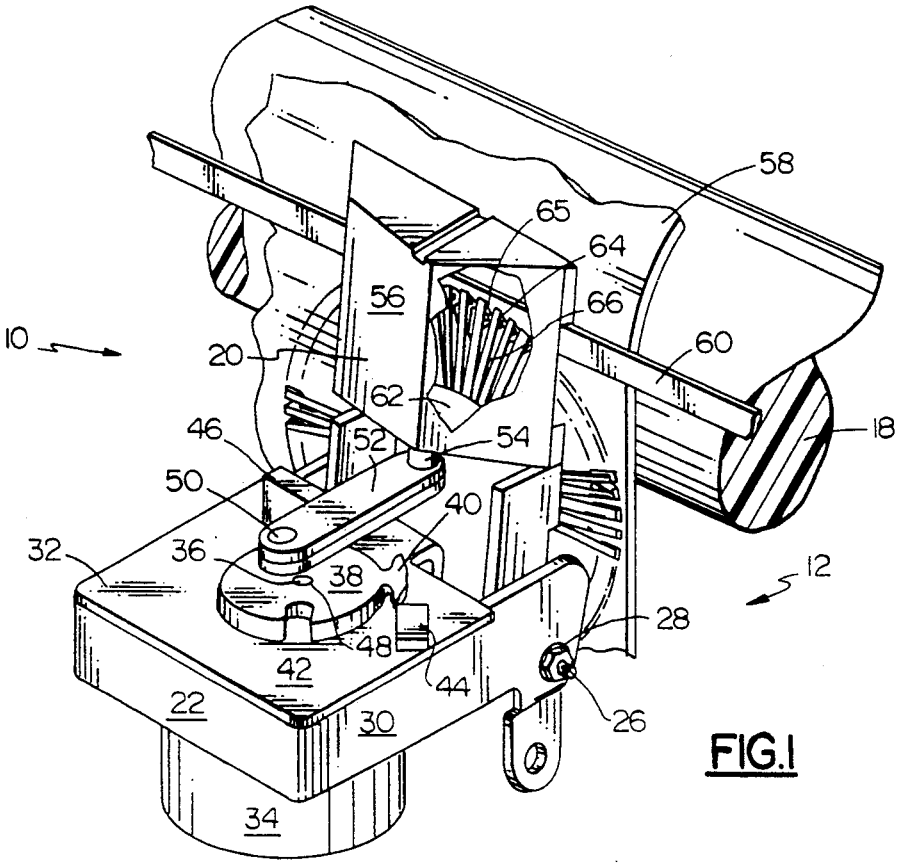
FIG. 1 is a perspective view of a printer mechanism with the printwheel coupling constructed in accordance with the present invention.

In the illustrated embodiment of FIG. 1 a printer mechanism 10 is horizontally supported in a printing device 12, such as a typewriter or printer, on a movable carrier 14 (see FIG. 2) for lateral movement on a guide rail 16 along a platen 18. The print hammer 20 includes a bracket 22 which is pivotally supported on the horizontally movable carrier 14 (not shown) by screw pins 26 (only one shown). The screw pins 26 extend through openings 28 in opposite bracket walls 30 and 32 and corresponding openings in the carrier. Screw pins 26 which extend through openings 28 of bracket 30 also extend through a tubular shaft (not shown) of the print hammer 20 for joining bracket 30 with the tubular shaft. In this manner, print hammer 20 is pivotable about the tubular shaft.

The bracket 22 also supports a reversible D.C. electric motor 34 between opposed walls 30 and 32. This motor 34 is provided with electrical contacts in a known manner so that when voltage of one polarity is applied, the motor shaft 36 will rotate in one direction and when the polarity is reversed, the motor shaft 36 will rotate in the opposite direction.

A rotary member 38 is mounted for rotation on the upper end of motor shaft 36 and rotary member 38 includes an outwardly extending "T" shaped stop 40. Supported on the upper face 42 of bracket 22 are a pair of stop abutments 44 and 46 for limiting the angular rotation of the rotary member 38. The motor shaft 36 extends into a central bore 48 of rotary member 38 whereby rotary member 38 is rotated by the motor shaft 36. Rotary member 38 carries an upwardly extending coupling pin 50 which rotates about central bore 48.

Link arm 52 is coupled to pin 50 and translates the rotary movement of rotary member 38 to linear reciprocating movement of the shaft 54 resulting in pivoting movement of the mass weight 56 about the tubular shaft. Pivoting movement of the print hammer 20 moves the print hammer 20 toward and away from the platen 18.

Supported between the platen 18 and the print hammer 20 is an image print medium such as paper sheet 58, an ink ribbon 60 and a print element such as a daisy printwheel 62. The printwheel 62 is controlled for selected rotation to present a selected character pad 64, carried at the free end 65 of a petal 66 of the printwheel 62, at the typewriter print point PP.

Figure 2:
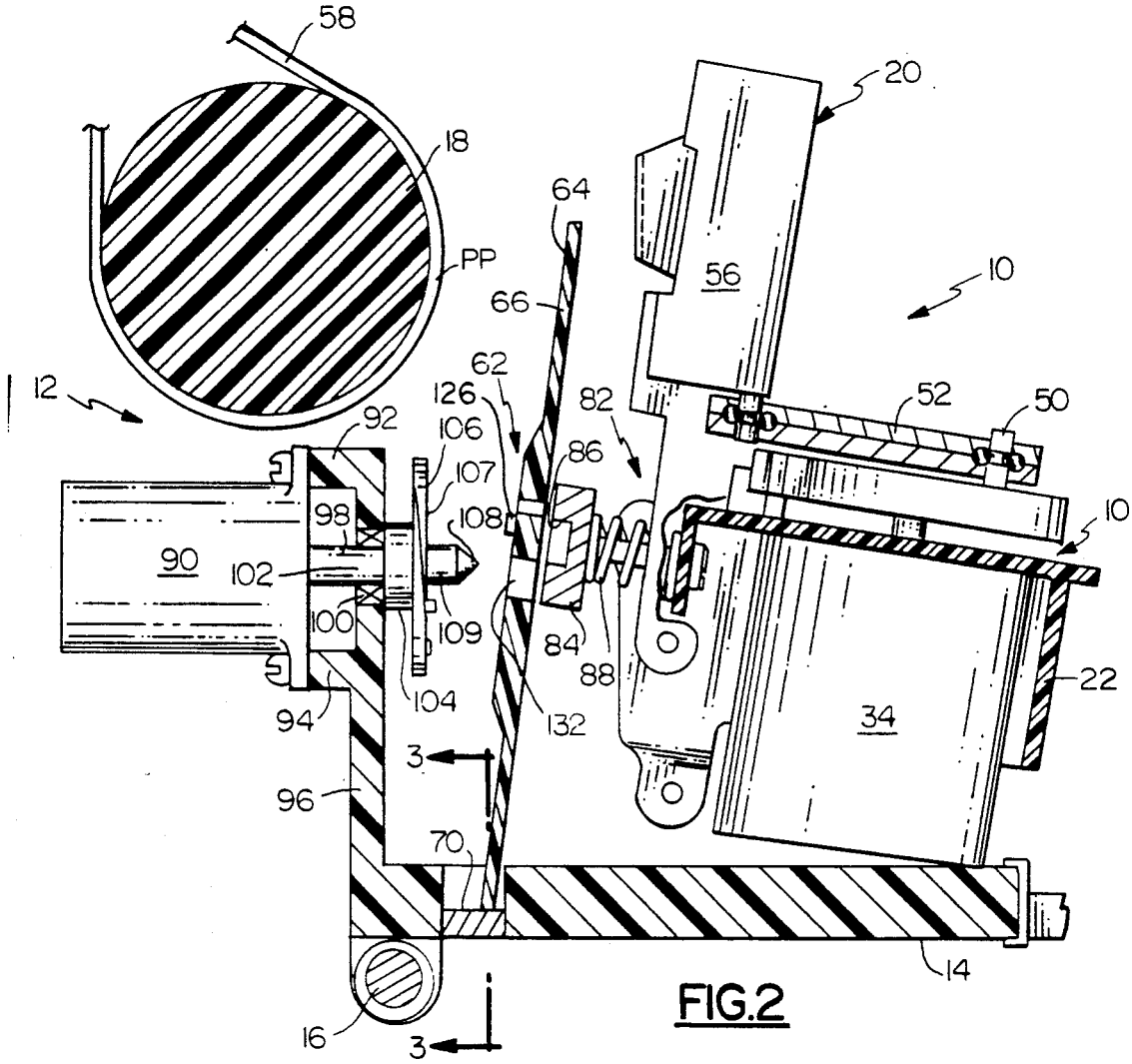
FIG. 2 is a side elevational view taken along the centerline of the printer mechanism of FIG. 1 showing the printwheel coupling constructed in accordance with the present invention and with the printwheel disengaged from the drive plate and the printer mechanism in the retracted position.
Figure 3:
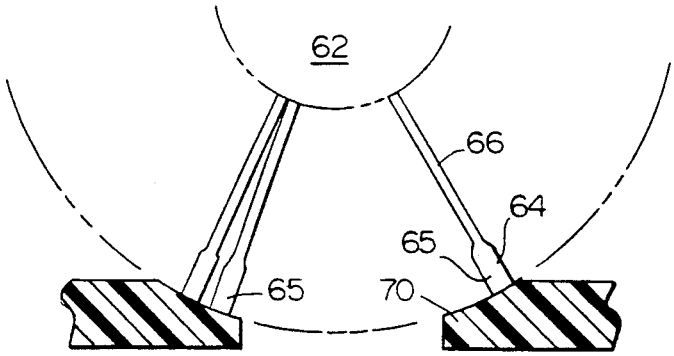
FIG. 3 is a partial sectional view of the printwheel petals of FIG. 2 taken along line 3—3.

With reference to FIGS. 2 and 3, there is shown the printer mechanism 10 in its retracted position with the printwheel 62 disengaged. The forward end 82 of the printer mechanism 10 carries a spring loaded pressure plate 84 which includes a cylindrically shaped shaft clearance opening 86. The pressure plate 84 is urged outwardly of the printer mechanism 10 by spring 88 which is disposed about the pressure plate 84.

Printwheel control motor 90 is horizontally supported by extensions 92 and 94 of vertical carrier wall 96 with its motor drive shaft 98 extending toward the pressure plate 84 of printer mechanism 10. The motor drive shaft 98 is rotatably supported in bearing 100 which is disposed in carrier wall 96. The drive shaft 98 carries at one end 102, for rotation therewith, a collar 104. Collar 104 is formed integral with the drive plate 106 to affix the drive plate 106 to the drive shaft 98. A central locating pin 109 extends from the motor drive shaft 98 and is formed with a bevelled tip 108. The pin 109 extends beyond the opposite face 107 of the drive plate 106. With the printer mechanism 10 in its retracted position, the printwheel 62 can be removed and changed. The printwheel rotary drive means includes the printwheel control motor 90 and all of the structural elements connected between the printwheel control motor 90 and the printwheel 62.

FIG. 3 shows the printwheel 62 of FIG. 2 while disengaged with the free ends 65 of the character pads 64 resting on the base portion 70 of carrier 14. Generally, this is the position into which the printwheel 62 is placed by the user when inserting the printwheel 62 into the printing device 12. The central opening 132 of the printwheel 62 is located between the bevelled tip 108 and the pressure plate 84 (see FIG. 2). When the pressure plate 84 is moved toward the central locating pin 109 (from its position shown in FIG. 2), as the printer mechanism 10 assumes its forward printing position, the central locating pin 109 enters the printwheel central opening 132 (as shown in FIG. 8).

Figure 4:
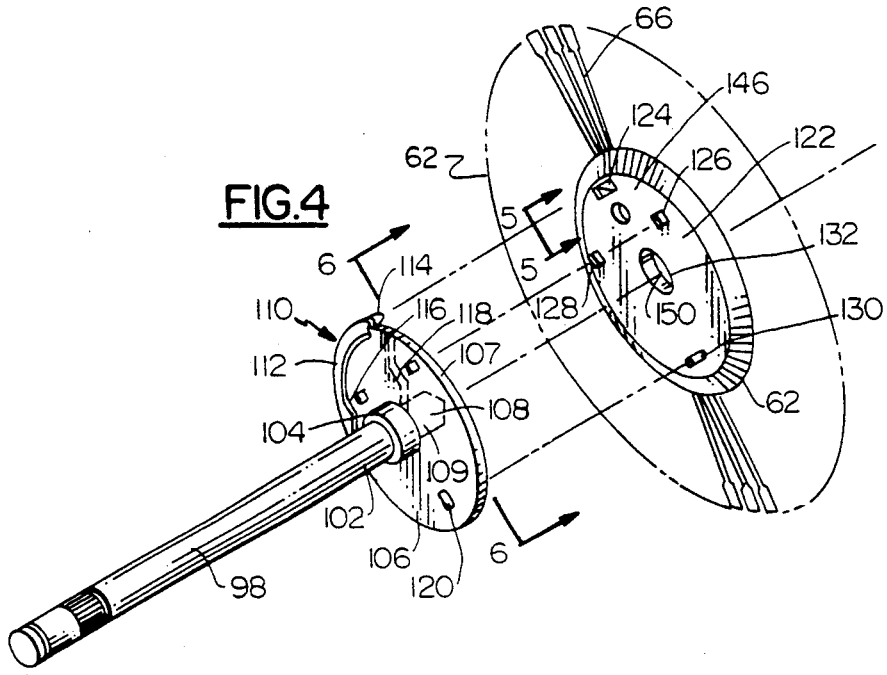
FIG. 4 is an exploded perspective view of the printwheel and the drive plate of the printer mechanism made in accordance with the present invention.
Figure 6:
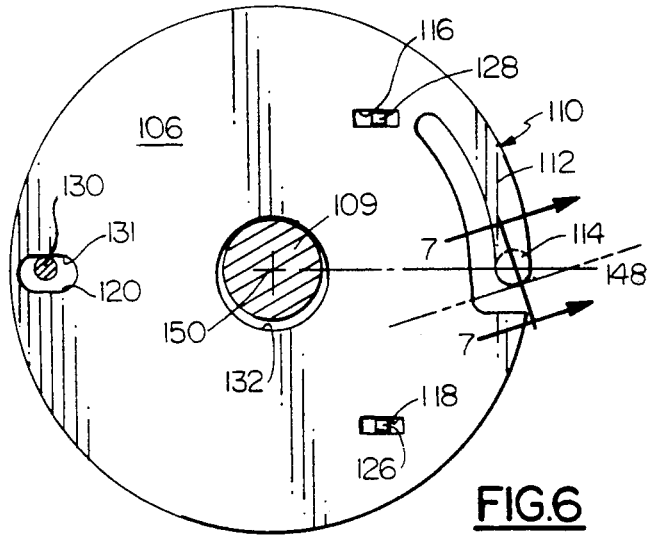
FIG. 6 is an enlarged front elevational view of the drive plate of FIG. 4 taken along line 6—6 when the drive plate and the printwheel are engaged.

In the exploded view of FIG. 4 and elevational view of FIG. 6 the drive plate 106 is formed with a resilient biasing means 110 such as, integral cantilevered spring finger 112 which carries a forwardly extending alignment pin 114. The drive plate 106 further includes a pair of rectangular Openings 116 and 118 and an alignment slot 120. The alignment slot 120 and alignment pin 114 are located On opposite sides Of the collar 104.

Figure 7:
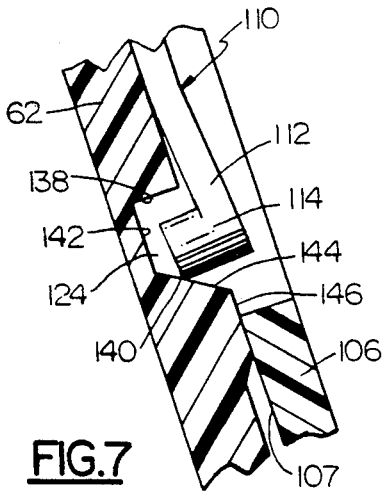
FIG. 7 is a partial cross-sectional view of the alignment pin of FIG. 6 taken along line 7—7 with the alignment pin disposed in the printwheel recess.
Figure 5:
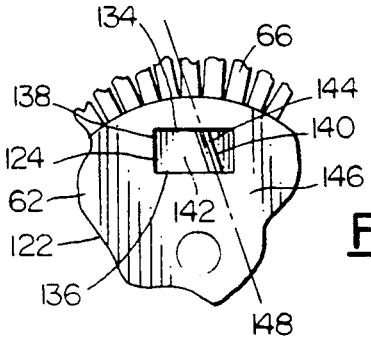
FIG. 5 is a partial front elevational view of the printwheel of FIG. 4 taken along line 5—5.

The printwheel 62 includes a central hub 122 from which petals 66 radiate. The central hub 122 is formed with a recess 124, a pair of spacing projections 126 and 128 and a drive pin 130 located on opposite sides of the recess 124. Central opening 132 of printwheel 62 is formed to freely receive central locating pin 109 of drive plate 106. The recess 124, as shown in FIG. 5, includes outward wall 134 and inward wall 136, endwalls 138 and 140 and a base 142. Endwall 140 slopes inwardly to define a cam surface 144 (see FIG. 7) which extends from the outer face 146 of central hub 122 to base 142. The intersection of the cam surface 144 with base 142 (horizontal plane) defines a cam surface axis 148 (see FIGS. 5 and 6). Cam surface axis 148 is offset from any radius extending from the hub center 150.

Figure 8:
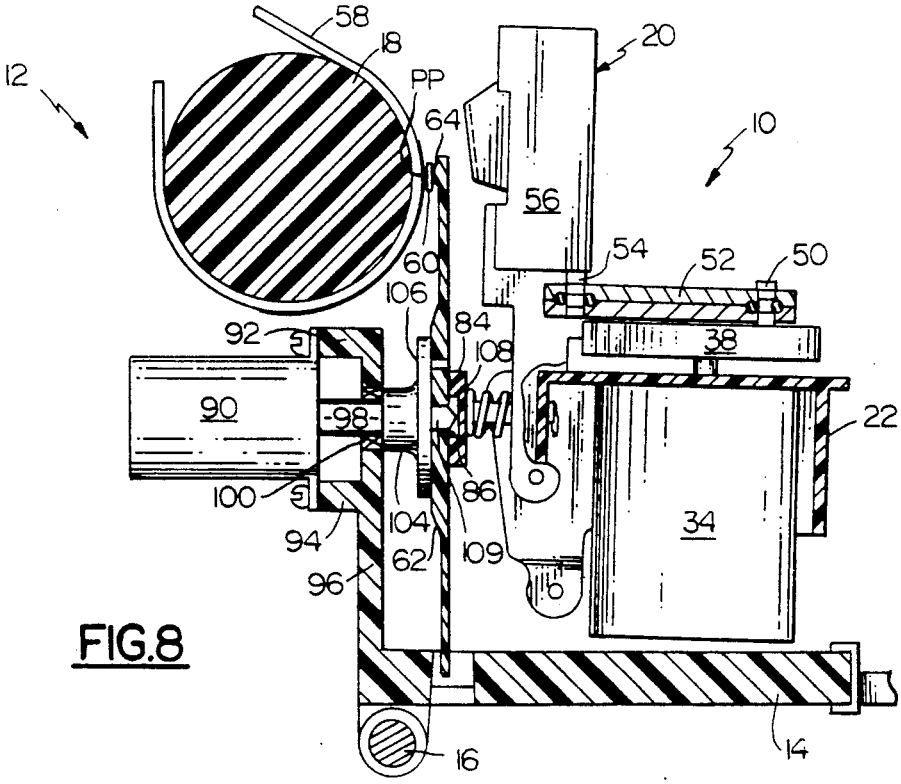
FIG. 8 is a view similar to that of FIG. 2 except that the printwheel is engaged to the drive plate and the print mechanism is in the printing position.

The printwheel 62 is initially positioned, into the printing device 12 as shown in FIG. 2, and thereafter the user pivots the bracket 22 so that the printwheel 62 and printing device 12 are in the position illustrated in FIG. 8. Relative movement in the central opening 132 can occur since the central opening 132 in hub 122 is larger than the drive plate locating pin 109. This sizing permits the printwheel 62 to be readily positioned on the locating pin 109 by pressure plate 84. Drive plate 106 is then started rotating clockwise (see FIGS. 4 and 6) by motor 90 relative to printwheel 62, due to slight friction between the pressure plate 84 and the printwheel 62 as the printwheel 62 is urged toward the drive plate 106 by pressure plate 84. The alignment pin 114 of drive plate 106 automatically enters recess 124 of central hub 122 and engages the cam surface 144 by the drive plate 106 rotating relative to the printwheel 162. Also during the initial movement of the printwheel 62 toward the drive plate 106, the projections 126 and 128, carried on the outer face 146 of central hub 122, abut the opposite face 107 of drive plate 106. The projections 126 and 128 and the drive pin 130 maintain drive plate 106 and the printwheel central hub 122 parallel to each other prior to the alignment pin 114 engaging the cam surface 144. The drive plate 106 and the printwheel central hub 122 are maintained parallel to each other at this time to prevent the outer circumference of the print wheel 62 from hitting machine parts during rotation of the printwheel 62. The continuing rotational force applied by alignment pin 114 against the offset cam surface 144 includes a small outwardly directed radial force component. The effect of this radial force component is to inhibit radial movement of the printwheel 62 relative to the drive plate central locating pin 109. Continued closure of the separation between the drive plate 106 and the printwheel central hub 122 under the lateral force applied by pressure plate 84, while the rotating alignment pin 114 continues to apply a rotational force against the cam surface 144, drives the drive pin 130 into the drive plate aligning slot 120. The continuing rotational force of alignment pin 114 drives drive pin 130 against aligning slot wall 131 (see FIG. 6) to thereby inhibit any relative angular motion between the drive plate 106 and printwheel 62.

It should be noted that when the drive pin 130 bears against slot wall 131, alignment pin 114 bears against cam surface 144 at some depth level between the outer face 146 and base 142 of recess 124. Due to normal manufacturing dimensional variations, the alignment pin 114 point of contact on the cam surface 144 can not be accurately controlled. However, by mounting the alignment pin 114 on a resilient biasing means such as spring finger 112, the alignment pin 114 will provide rotational contact with the cam surface irrespective of the depth to which the alignment pin 114 penetrates the recess 124.

Obviously many modifications and variations of the present invention are possible in the light of the above teachings. It is therefore to be understood that, within the scope of the appended claims, the invention may be practiced otherwise than specifically described.

Having thus described the invention, what is claimed as novel and desired to secure by Letters Patent is:

1. A printing device having a platen, an image print medium supported by said platen, a carrier mounted for movement along said platen, a printwheel having a hub, a hub center and character pads, a printwheel rotary drive means mounted on said carrier for imparting selected printwheel rotary movement about said hub center, an impact printer mechanism for driving a selected character pad to print a character on said image print medium and printwheel coupling means comprising:

offset rotary drive coupling means joining said printwheel and said printwheel rotary drive means for joint rotation thereof including said hub having a recess formed therein;

a drive plate affixed to said printwheel rotary drive means; and a spring finger integrally formed from said drive plate for automatically entering said recess when said drive plate rotates relative to said printwheel for eliminating relative radial movement between said printwheel and said printwheel rotary drive means.

2. The printing device according to claim 1 wherein said recess in said hub includes a sloped endwall defining a cam surface.

3. The printing device according to claim 2 wherein said recess includes a horizontal plane and an intersection of said cam surface and said horizontal plane defines a cam surface axis, and said cam surface axis is angularly offset from any radius extending from said hub center of said printwheel.

4. The printing device according to claim 3 wherein said spring finger carries an alignment pin disposed to bear against said cam surface when said printwheel hub and said drive plate are proximate one another.

5. The printing device according to claim 4 further including a drive pin formed on said hub radially opposite said recess.

6. The printing device according to claim 5 further including an alignment slot formed in said drive plate opposite said alignment pin for receiving said drive pin when said alignment pin bears against said cam surface for preventing relative angular movement between said printwheel and said printwheel rotary drive means.

* * * * *